US007937895B2

(12) United States Patent
Janka et al.

(10) Patent No.: US 7,937,895 B2
(45) Date of Patent: May 10, 2011

(54) AIR HANDLING CHAMBER

(75) Inventors: Troy M. Janka, Owatonna, MN (US); Michael S. Peterson, Lakeville, MN (US); Thomas R. Peterson, Lakeville, MN (US)

(73) Assignee: Concepts and Designs, Inc., Owatonna, MN (US)

( * ) Notice: Subject to any disclaimer, the term of this patent is extended or adjusted under 35 U.S.C. 154(b) by 0 days.

(21) Appl. No.: 11/397,921

(22) Filed: Apr. 3, 2006

(65) Prior Publication Data

US 2007/0261345 A1 Nov. 15, 2007

(51) Int. Cl.
*E04H 1/00* (2006.01)

(52) U.S. Cl. ..... 52/79.1; 52/309.9; 52/270; 52/425; 52/794.1

(58) Field of Classification Search ..... 312/400, 312/401, 406, 409, 236; 52/424, 309.9, 79.1, 52/270, 425, 794.1
See application file for complete search history.

(56) References Cited

U.S. PATENT DOCUMENTS

| | | | | | |
|---|---|---|---|---|---|
| 1,775,989 | A | * | 9/1930 | Dennison | 62/405 |
| 2,622,710 | A | | 12/1952 | Haas | |
| 2,815,649 | A | * | 12/1957 | Di Angelus et. al. | 312/408 |
| 2,896,271 | A | * | 7/1959 | Kloote et. al. | 52/63 |
| 3,477,668 | A | * | 11/1969 | Tippmann | 248/646 |
| 4,118,266 | A | | 10/1978 | Kerr | |
| 4,217,010 | A | | 8/1980 | Webb | |
| 4,257,202 | A | | 3/1981 | Biro | |
| 4,332,552 | A | | 6/1982 | Seelandt | |
| 4,421,972 | A | | 12/1983 | Duncan et al. | |
| 4,540,587 | A | | 9/1985 | Gajewski | |
| 4,754,587 | A | | 7/1988 | Glaser | |
| 5,497,708 | A | * | 3/1996 | Jeruzal | 108/54.1 |
| 5,584,188 | A | | 12/1996 | Tippmann et al. | |
| 5,860,265 | A | | 1/1999 | Knudson et al. | |
| 6,004,384 | A | | 12/1999 | Caudle | |
| 6,032,474 | A | | 3/2000 | Dale et al. | |
| 6,224,179 | B1 | * | 5/2001 | Wenning et al. | 312/406 |
| 6,374,571 | B1 | | 4/2002 | Mann | |
| 6,490,874 | B2 | | 12/2002 | Chu et al. | |
| 6,520,124 | B2 | * | 2/2003 | Bohm, II | 123/2 |
| 6,575,228 | B1 | | 6/2003 | Ragland et al. | |
| 6,736,473 | B2 | * | 5/2004 | Cleveland et al. | 312/409 |
| 6,847,013 | B2 | | 1/2005 | Audette et al. | |
| 6,868,688 | B2 | | 3/2005 | Narehood | |
| 6,871,600 | B2 | * | 3/2005 | Norton et al. | 105/404 |
| 2004/0149757 | A1 | | 8/2004 | Lewis et al. | |
| 2005/0034390 | A1 | * | 2/2005 | Dubensky et al. | 52/220.1 |

OTHER PUBLICATIONS

Concept and Designs Inc., *NTM Base Frame Review*, Apr. 4, 2005, 28 pages.
Concept and Designs Inc., *"No Sweat"*, May 4, 2005, 5 pages.

* cited by examiner

*Primary Examiner* — Darnell M Jayne
*Assistant Examiner* — Matthew W Ing
(74) *Attorney, Agent, or Firm* — Patterson Thuente Christensen Pedersen, P.A.

(57) ABSTRACT

An air chamber for the housing of air handling components including an interior shell surrounded by an exterior shell, the shells being separated by materials of relatively low thermal conductivity. The interior shell is peripherally mounted on an interior base. The interior base is disposed within an exterior base that supports the exterior shell. A structural thermal insulation material is disposed interstitially between the interior and exterior bases and the interior base and interior shell are thermally isolated from the exterior base and exterior shell.

8 Claims, 14 Drawing Sheets

AIR HANDLING CHAMBER

TECHNICAL FIELD

This invention relates to air handling equipment. Specifically, it relates to thermal isolation of chambers that house heating, ventilation and air conditioning components.

BACKGROUND ART

The delivery of a cool, dry air stream is necessary for a variety of applications ranging from industrial processes (e.g. plastics, food processing), to comfort control of large indoor spaces, to clean room environment control. Air handling chambers are designed to house the appurtenances necessary for the treatment of such air flow streams. The chambers are designed to accommodate a variety of components, depending on the application (e.g. cooling coils, desiccant wheels, and filtration systems).

The temperature within an operating air handling chamber is often substantially below the temperature surrounding the chamber. Such chambers are often deployed in high humidity environments. For example, outdoor or roof mounted chambers are routinely exposed to high temperature, high humidity ambient conditions associated with summer time operation. Indoor units are often installed within a high humidity environment associated with the process that requires air handling.

Conventional air handling chambers utilize a modular panel design. The walls of the chamber are constructed from pre-formed panels that mate with each other along jointed seams. The panels typically have a hard (often metallic) shell that is filled with a thermal insulation material. Some modular panel designs feature edges that are enclosed with the shell material, so that the mating edges of abutting panels have a stiff interface suitable for the insertion of a sealing material. The shell, typically constructed from a higher thermal conductivity material than the insulation material within, thermally bridges the thickness of the panel, creating a zone of lower temperature on the shell exterior along the seam of the joint. Condensation can form and accumulate when the temperature of these zones fall below the dew point temperature of the surrounding air.

Other designs leave the insulation exposed on the panel edges, the insulating material of one panel being formed to mate directly with the insulation of an adjoining panel. Such designs are more difficult to seal with interstitial materials at the joints and are prone to leakage of the cooler interior air because insulation materials tend to be of lower density and are less resistant to wear. Leakage through the joints effectively cools the outer surfaces of the panels near the seams, which also leads to the formation and accumulation of condensation on the exterior shell.

Conventional air handling chambers also utilize a base design that is prone to the formation of external condensation. Some chambers house heavy components, such as high capacity compressors or large banks of air-to-fluid heat exchangers. For the sake of rigidity, standard base structures form a thermal bridge between the chamber interior and the exterior of the base.

The food processing industry is particularly sensitive to condensation or "sweating" on the exterior of air handling equipment. Accumulation of condensation leads to the formation of droplets that can fall into food products or otherwise contaminate sanitized areas. Even outdoor units can cause contamination of food processing areas. For example, a roof-mounted unit typically has ductwork that extends from the bottom of the chamber and into the building through the roof. Condensation that forms on the exterior of the walls and base of the chamber can flow downward, attach to exterior of the ducting and make its way into the food processing area, thereby posing a contamination risk. The Food and Drug Administration has recognized the health risks associated with condensation in food processing facilities, and has promulgated rules and guidelines regarding condensation on air handling enclosures. See, e.g., 9 CFR Part 416, "Sanitation Requirements for Official Meat and Poultry Establishments, Final Rule," 2000.

Heat flux through a solid medium, expressed in Watts per square meter, is directly proportional to the thermal conductivity of the medium (hereinafter referred to as k) and inversely proportional to the thermal path length (hereinafter referred to as L). That is, heat flux is proportional to the ratio k/L. In the case of a planar wall such as utilized in a thermal isolation chamber, the thermal path length L is dominated by the thickness of the insulation between the inner and outer wall assembly. A thicker wall enables the use of a higher conductivity material, whereas a thin wall requires the use of a lower conductivity material to maintain the exterior temperatures above the dew point temperature.

Generally, the thermal conductivity of so-called "thermal insulation" or "thermal insulative" materials can be of any magnitude, provided the available thermal path length L is long enough (i.e. the wall is thick enough) to maintain the exterior temperatures above the dew point temperature.

There exists a need for an air handling chamber design that minimizes or avoids the formation of condensation on exterior surfaces, yet is readily adapted to the construction of chambers of various sizes.

SUMMARY OF THE INVENTION

The air handling chamber in accordance with the present invention in large measure solves the problems outlined above. The wall, ceiling and base structures of the air chamber hereof thermally isolate the external surfaces and the base from the chamber interior, thus preventing the formation of exterior condensation. Inherent advantages of the design also include improved wall strength, enhanced thermal efficiency, less leakage into or out of the controlled gas stream, and improved suppression of the noise generated by the components within the chamber. Moreover, the method of construction allows the designer to specify a chamber of any size and walls of any thickness without compromising the thermal and flow containment integrity of the unit.

The side walls of certain embodiments of the invention have a continuous outer wall and a continuous inner wall with no structural element bridging the two walls. That is, if the inner wall and outer wall are each made of metal, there is no need for a metallic bridge to exist between the two structures. A gap separates the two walls and is filled with an insulation material to thermally isolate the interior of the chamber from the exterior wall. Likewise, the top of the chamber has a continuous internal ceiling and a continuous external roof, with no direct contact therebetween. The roof and ceiling are separated by a gap that may be filled with a rigid insulation board that is self supporting and provides additional strength to the structure.

For larger embodiments, each interior or exterior surface may be constructed by joining segments of sheet material together to form a continuous surface. In certain embodiments of the invention, flanges are formed on the abutting edges of the segments. The segments are then joined at the flanges by crimping, welding, fusing, riveting, capping or by other joining techniques available to the artisan. The joined flanges create a rib that protrudes from one surface of the joined segments. The rib may be oriented to extend into, but not all the way across, the gap, to provide essentially continuous surfaces on the interior and exterior of the chamber. The ribs also serve to stiffen the structure.

With many joining techniques, seams will be formed at each junction between adjacent sheets. The seams on the outer wall may be offset or "staggered" with respect to the seams on the inner wall. A staggered arrangement lengthens the leak path between seams through the insulation, providing a better seal than with standard modular constructions. Also, for embodiments implementing flanged abutments that reside between the interior and exterior walls, the staggered arrangement provides a longer thermal path between the flange and the opposing wall than an arrangement where the flanges are directly opposite each other.

Accordingly, the various configurations of the present invention implement a structural scheme that combines the advantages of both increased thermal resistance and increased leak resistance through the sidewall assembly.

In another embodiment of the invention, the base assembly features an internal base structure and an external base structure. The internal base structure is mounted within the external base structure, with a thermally resistant interstitial material disposed between the two structures. The interior shell (interior wall and ceiling) is supported on the internal base structure, and the exterior shell (exterior wall and roof) is supported on the external base structure. The base structures are characterized by large interfaces in contact with the interstitial material to distribute the weight of the chamber and appurtenances within over a large area. The distributed load allows the use of non-metallic or non-structural material as the interstitial material, thereby increasing the thermal resistance between the internal and external base frames. Also, any appendages or penetrations that pass through the base assembly, side walls or roof (e.g. drain pan fixtures, electrical conduits, etc.) are also thermally broken between the interior surface and the exterior surface by bifurcating the appendage or penetration into an interior and an exterior segment, and interposing a low conductivity coupling therebetween.

The spatial and structural constraints of the subject thermal isolation chambers provide for the use of insulation materials having a thermal conductivity of 1 Watt per meter per Kelvin or less. Such insulators have a thermal conductivity that is substantially lower (an order of magnitude or more) than the metals commonly used in construction of the chamber walls. The thermal isolation provided by the structure of the air chamber is greatly improved over conventional chambers.

DETAILED DESCRIPTION OF THE INVENTION

Figure 2:
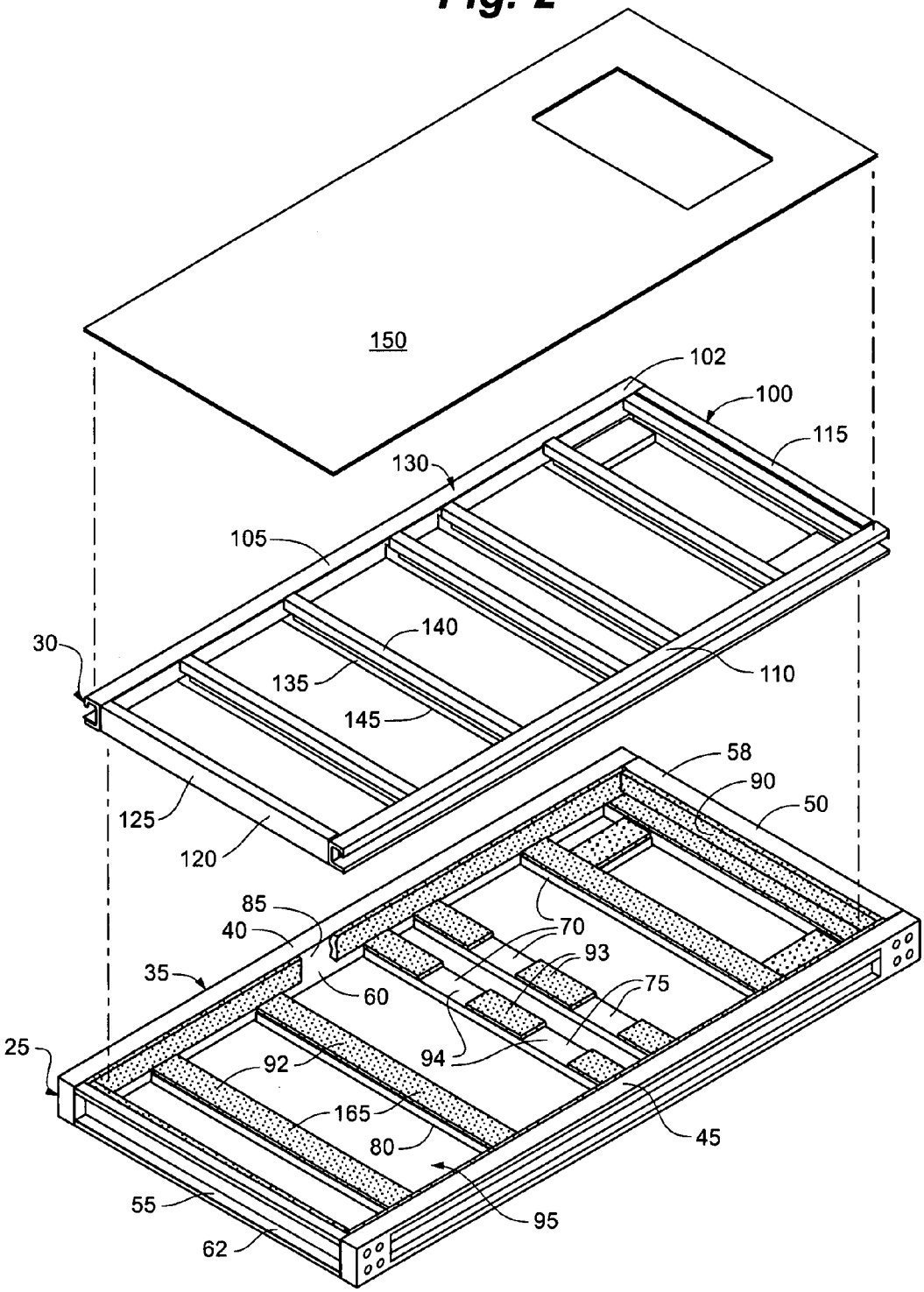
FIG. 2 is a partially exploded view of the air chamber base assembly.
Figure 3:
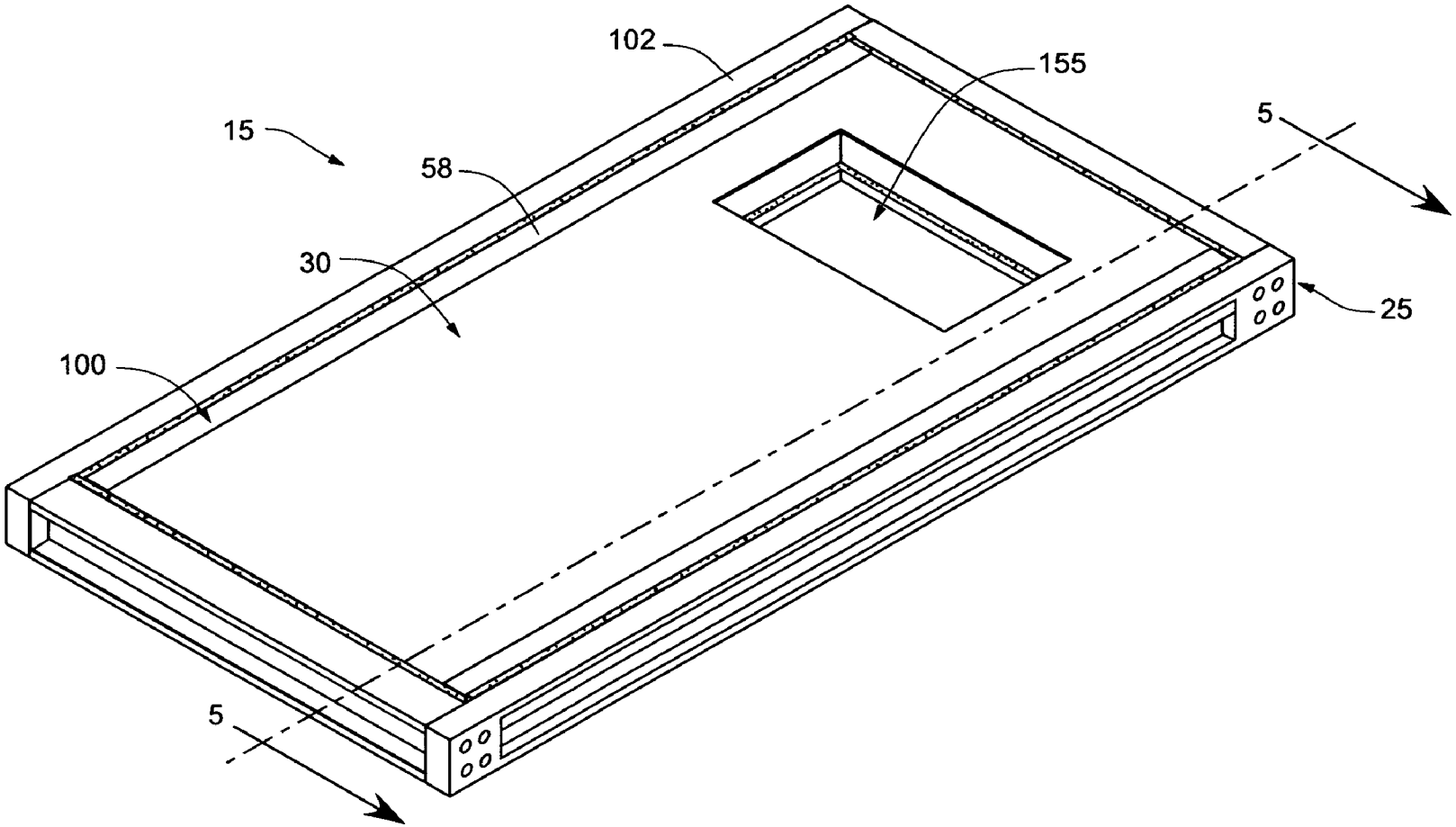
FIG. 3 is a perspective view of the base assembly depicted in FIG. 2.
Figure 4:
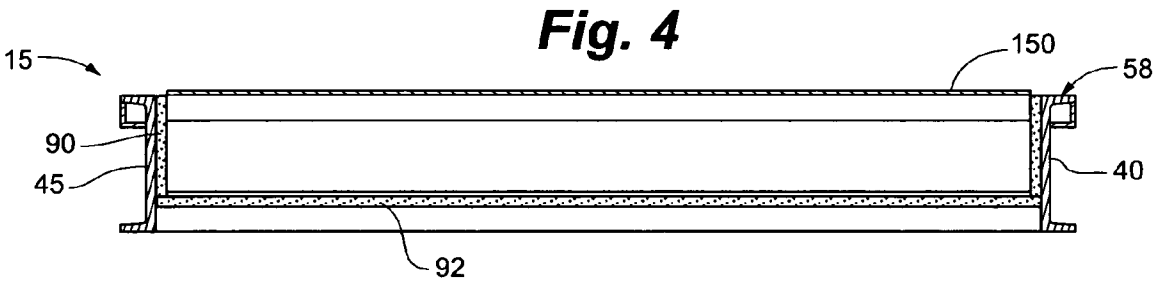
FIG. 4 is a sectional end view of the base assembly.
Figure 6:
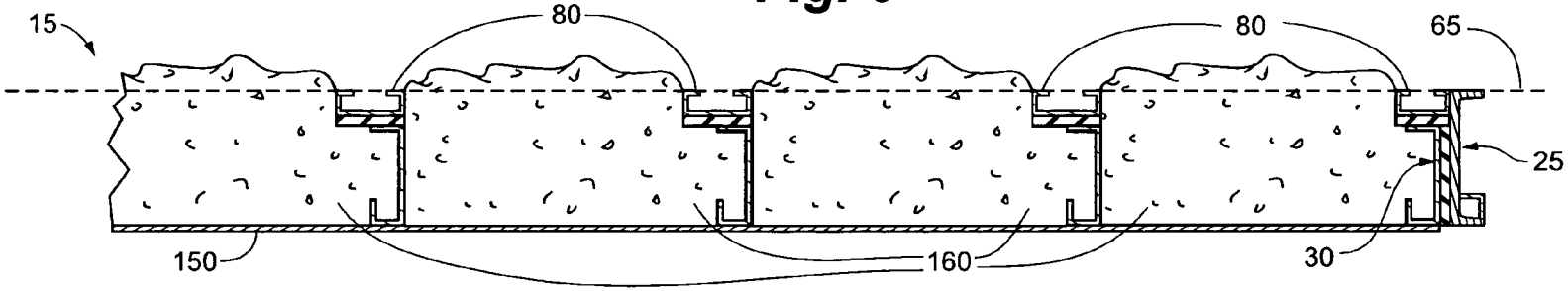
FIG. 6 is a fragmentary sectional side view of the base assembly.

Referring to the drawings, a thermally broken chamber 10 includes a base assembly 15 and an upper assembly 20. Referring to FIGS. 2 through 4, the base assembly 15 includes an exterior base 25 and an interior base 30. The exterior base 25 is generally rectangular and has an exterior frame 35 having side members 40, 45 and end members 50, 55. The exterior frame 35 defines an interior perimeter 60, and outer perimeter 62 and a lower or grounding plane 65. The exterior base 25 also includes a number of cross members 70 that extend between the side members 40 and 45 of the base frame 35. The cross members 70 each have an upper surface 75 and a lower surface 80. The lower surfaces 80 of the cross members 70 may be arranged flush with the lower plane 65, as illustrated in FIGS. 2 and 6.

The interior perimeter 60 of the exterior frame 35 has an upper portion 85 extending above the upper surfaces 75 of the cross members 70, best portrayed in FIG. 4. The upper portion 85 of the interior perimeter 60 and the upper surfaces 75 of the cross members 70 are lined with structural thermal insulation materials 90 and 92, respectively.

Figure 5:
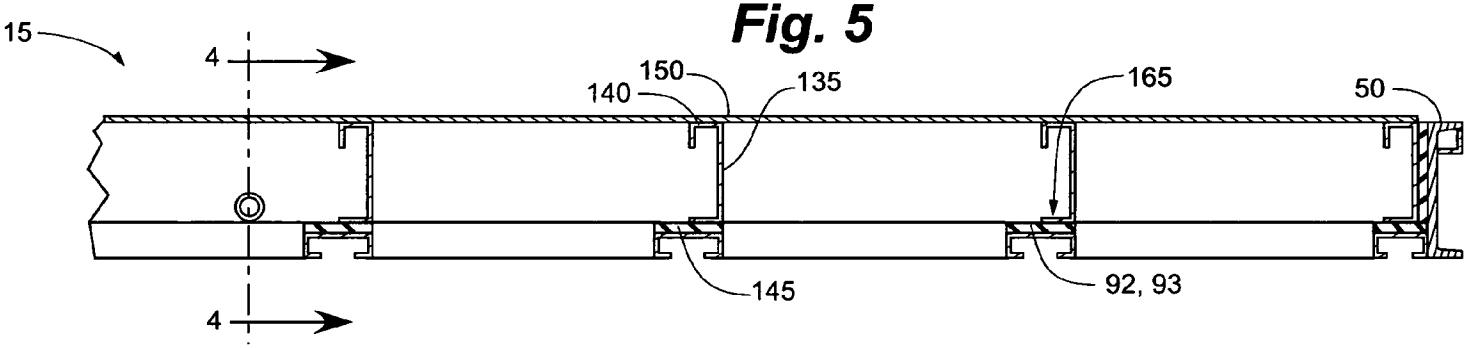
FIG. 5 is a sectional view taken along line 5-5 of FIG. 3.

Referring again to FIG. 2, the lined surfaces of the exterior base 25 define a caging 95 that houses interior base 30. The interior base 30 includes an interior frame 100 having side members 105, 110 and end members 115, 120. The interior frame 100 has a top face 102 and defines an exterior perimeter 125 and an upper plane 130. The interior base 30 has a number of cross members 135 that extend between the side members 105 and 110 of the interior frame 100. Referring to FIG. 5, the cross members 135 are positioned within the interior frame 100 to align with the cross members 70 of the exterior base 25 longitudinally when the interior base 30 is placed within the caging 95 of the exterior base 25. Each of the cross members 135 of the interior base 30 are dimensioned so that an upper surface 140 is flush with the upper plane 130 and a lower surface 145 contacts the structural thermal insulation material 92 that lines the upper surfaces 75 of the cross members 70 of the exterior base 25 when the interior base 30 is placed within the caging 95 of the exterior base 25. The interior base also includes a floor plate 150 that generally covers the cross members 135 and interior frame 100. An air passage 155 or other access port may be provided through the floor plate 150, as required by the particular application.

By the arrangement described above, there is no direct contact between the exterior base 25 and the interior base 30. Rather, the structural thermal insulation materials 90 and 92 are interstitial between the structural interfaces of the exterior base 25 and the interior base 30. Where the interior base 30 and exterior base 25 are metallic, there is no metal that bridges the two structures, resulting in enhanced thermal isolation between the interior and exterior of the chamber 10.

Referring to FIG. 6, the base assembly 15 also includes a thermal insulation material 160 deposited between and within the cross members 70 and 135 of the exterior base 25 and interior base 30, respectively. The base assembly 15 may be inverted for this operation, so that the grounding plane 65 of the base assembly 15 is on top, as depicted in FIG. 6. Inverting the base assembly 15 entails capturing the interior base 30 within the exterior base 25 so that the base assembly 15 remains assembled during the inverting operation. Excess thermal insulation 160 that extends above the grounding plane is then removed flush with grounding plane 65. A cladding sheet (not depicted) may be affixed to the base assembly 15 at the grounding plane 65 to protect the underside of the base assembly 15.

Preferably, the thermal insulation material 160 is a multi-component polyurethane foam, such as HANDI-FOAM® Quick-Cure manufactured by Fomo Products, Inc. of Norton, Ohio. Foam insulation of this type can be injected into voids and comers in the base assembly 15, thereby providing uniform thermal insulation between the cross members 70 and 135.

For most applications, the structural thermal insulation material 90 that lines the upper portion 85 of the interior perimeter 60 of the exterior frame 35 is subject to less contact pressure than the structural thermal insulation material 92 that lines the upper surfaces 75 of the cross members 70. Accordingly, a material of lower density (and therefore typically lower thermal conductivity) may be used for the structural thermal insulation material 90 than for the structural load-bearing thermal insulation material 92.

Functionally, the use of numerous cross members 70 and 135, or the use of cross-members 70 and 135 having larger contact surfaces 75 and 145, respectively, allows the weight of the interior base 30 and any structure or appurtenances mounted thereon to be spread over a large contact area 165. For a given weight load, a larger contact area 165 will distribute the weight, reducing the contact pressure exerted on the interstitial structural thermal insulation material 92. A lower contact pressure typically allows the use of a lower density structural thermal insulation material 92, which in turn will generally decreases the thermal conduction between the exterior base 25 and the interior base 30. Accordingly, depending on the contact pressures of a particular application, a variety of materials may be used for the structural thermal insulation material 92, ranging from higher density structural plastics to moderate density rubber or silicone matting to lower density thermal insulation boards.

Furthermore, the use of a lower density structural thermal insulation material 90 will result in less heat conduction through the interior perimeter 60. Likewise, the thermal insulation material 160 reduces the thermal conduction between the floor plate 150 of the interior base 30 and the lower plane 65 of the base assembly 15. The reduced thermal conduction provided by the thermal break scheme of the base assembly 15 results in higher operating temperatures on the exterior surfaces of exterior base 25. As a result, there is less chance of forming or accumulating condensation on the exterior surfaces of the base assembly 15.

An alternative configuration for the thermal isolation between the interior base 30 and the exterior base 25 is also presented in FIG. 2. The upper surfaces 75 of the exterior cross members 70 may be only partially lined with a number of structural thermal insulation segments 93. Intermediate areas 94 between the structural thermal insulation segments 93 may be left exposed (as depicted) or fitted with a low density thermal insulation (not depicted). If the intermediate areas 94 are left exposed, air may serve as an insulator between the aligned cross members 70 and 135, or the void may be filled with thermal insulation 160 during the buildup of the base assembly 15 (see FIG. 6 and accompanying text).

Functionally, the structural thermal insulation segments 93 suspend the cross members 135 of the interior base 30 above the upper surfaces 75 of the exterior cross members 70, thereby preventing direct contact between the interior base 25 and the exterior base 30. The thermal conductivity through intermediate areas 94 are inhibited either by air, the thermal insulation 160, or a low density thermal insulation, and the functional utility of the unit may be enhanced over the configuration of FIG. 2. Again, where the interior base 30 and the exterior base 25 are of metallic construction, there is no metal-to-metal contact between the structures, resulting in greater thermal isolation between the interior and exterior of the chamber 10.

Figure 1:
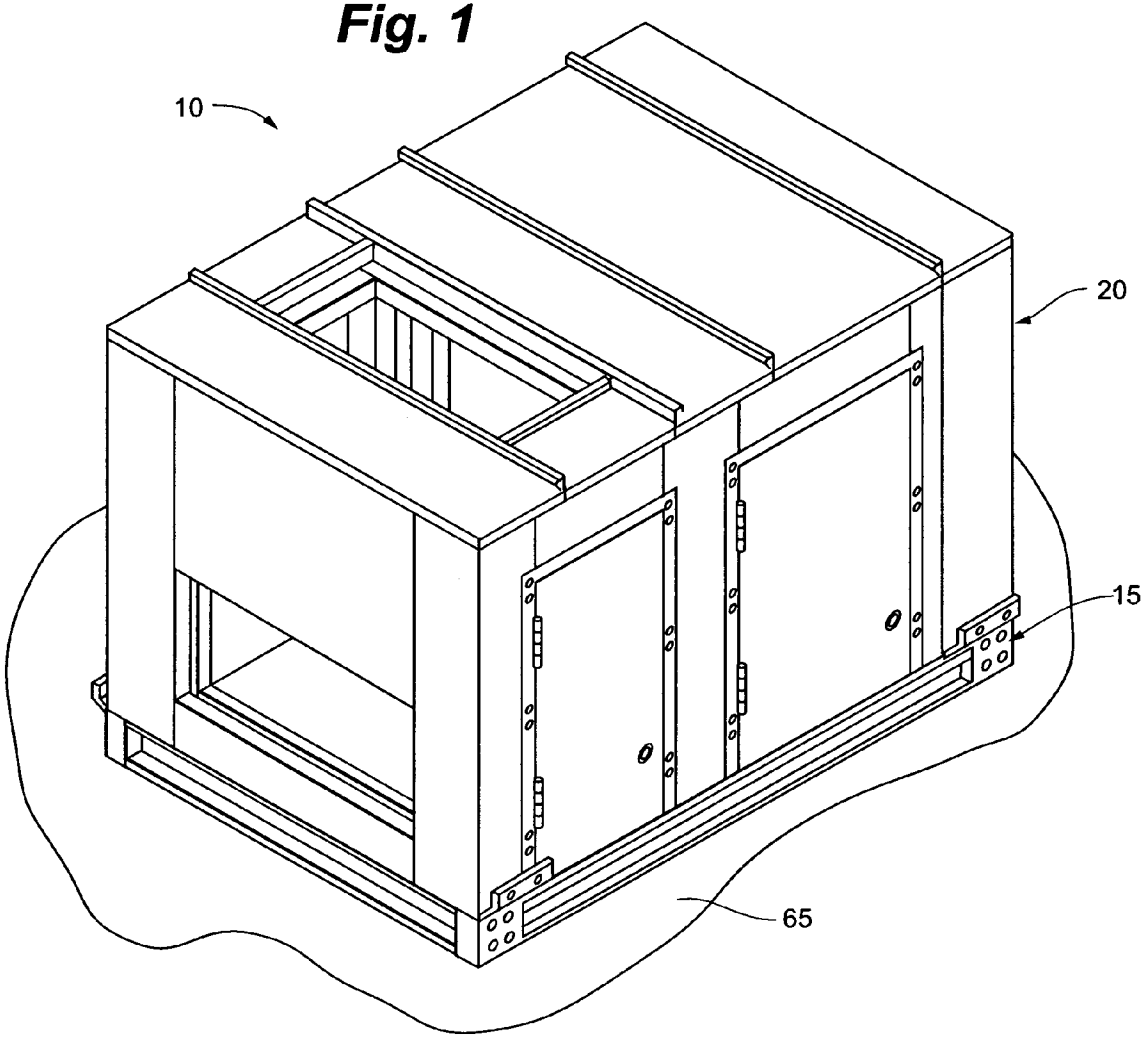
FIG. 1 is a perspective view of an air chamber in accordance with the present invention.
Figure 7:
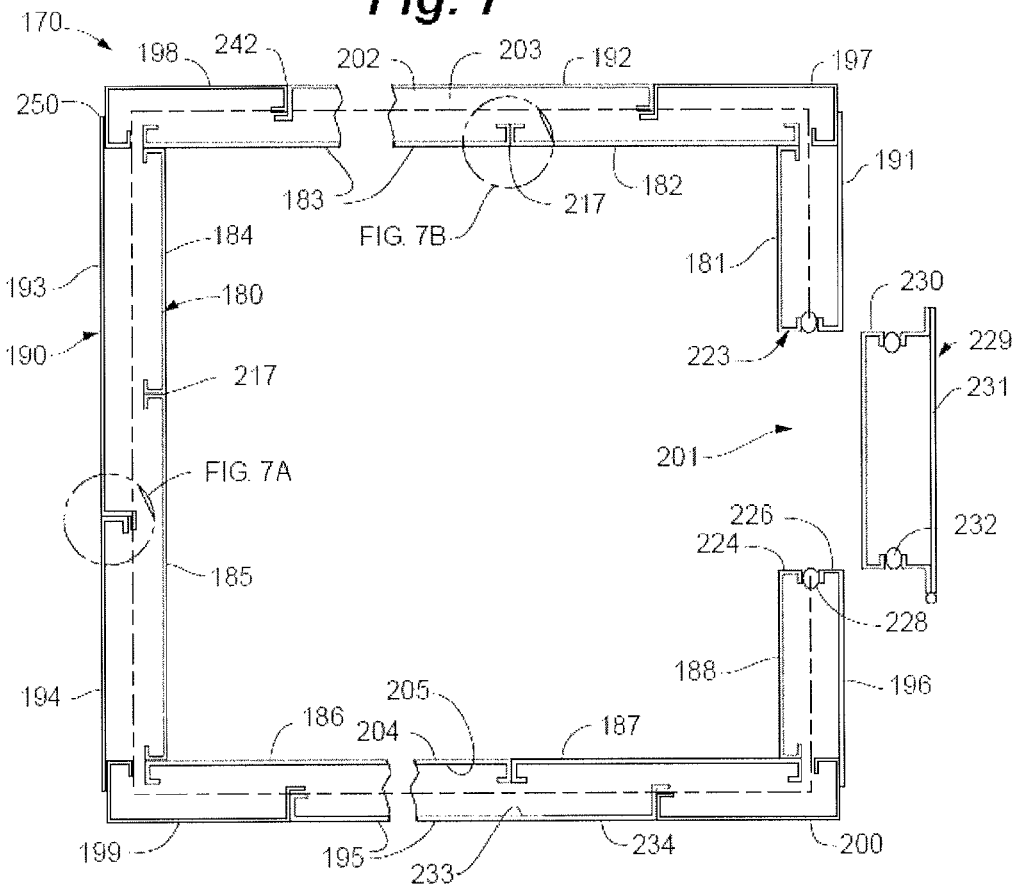
FIG. 7 is a fragmentary plan view of the sidewall assembly of the air chamber.
Figure 7A:
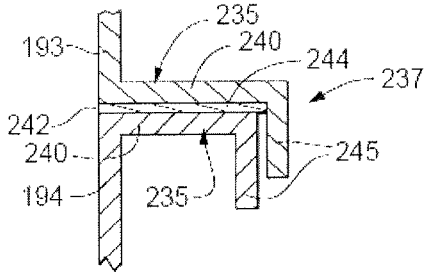
FIG. 7A is an enlarged view taken at 7A of FIG. 7.
Figure 7B:
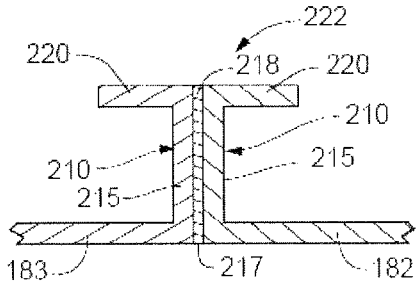
FIG. 7B is an enlarged view taken at 7B of FIG. 7.

Returning to FIG. 1, the upper assembly 20 of the thermally broken chamber 10 includes a sidewall assembly 170 and a cap assembly 175. Referring to FIGS. 7, 7A and 7B, an embodiment of the sidewall assembly 170 is depicted having an interior wall 180, an exterior wall 190, and an opening 201. The interior and exterior walls 180 and 190 are separated by a gap 202 that may be of constant dimension. The gap 202 defines a center line 203 equidistant between the interior wall 180 and the exterior wall 190. The interior wall 180 is a continuous structure that does not bridge to the exterior wall 190. The interior wall 180 may be constructed of a series of interior wall panels, as illustrated in FIG. 7 by numerical references 181 through 188. Each of the interior wall panels 181-188 have an inward surface 204 that faces toward the interior of the sidewall assembly 170 and an outward surface 205 that faces the gap 202.

The embodiment depicted in FIGS. 7, 7A and 7B has interior wall panels 181-188 with flanged edges 210, each flanged edge 210 having a rib portion 215 projecting perpendicular to the outward surface 205, and a free end portion 220 that depends from the rib portion 215 in a direction parallel to the outward surface 205. Adjacent interior wall panels 181-188 are joined by connecting the abutting rib portions 215 to each other, forming a seam 217 between the adjoined wall panels. A filler material 218 may be interstitially placed between the abutting rib portions 215. The version of the invention illustrated in FIG. 7 depicts the free end portions 220 extending over the outward surface 205, so that the abutting flanged edges 210 form a T-shaped cross-section 222. The configuration depicted in FIG. 7 represents the flanged edges 210 oriented within the gap 202, thereby providing a relatively smooth interior surface for interior wall 180.

While the invention is not limited to locating the flanges 210 within the gap 202, there are certain applications where such an arrangement provides advantages.

For example, orienting the flanges 210 within the gap 202 provides a smooth flow boundary for air flowing through the chamber, thus reducing frictional and turbulent head losses. Also, a smooth interior wall inhibits the growth of bacterial and is more readily cleaned—an important consideration for units servicing the food industry.

The opening 201 is defined by a split frame 223 having an inner portion 224 and an outer portion 226. The two portions 224 and 226 are separated by a thermal break 228, such as an o-ring or bellows made of a compliant material such as neoprene or silicone. The opening may be used as a doorway for chamber access, or as an airway for connecting ductwork. When the opening 201 is used as a doorway, a split door 229 may be mounted to form a closure. The door is of a construction similar to the split frame 223; specifically, it has an inner portion 230 and an outer portion 231 separated by a thermal break 232.

The function of the split frame 223 and split door 229 configurations is to reduce the thermal conduction between the interior of the thermally broken chamber 10 and the ambient surroundings. The thermal isolation provided by the thermal breaks 228 and 232 enable the exterior surfaces near the opening 201 to operate at a higher temperature, thereby inhibiting the formation and accumulation of condensation on the exterior of the thermally broken chamber 10.

Figure 8:
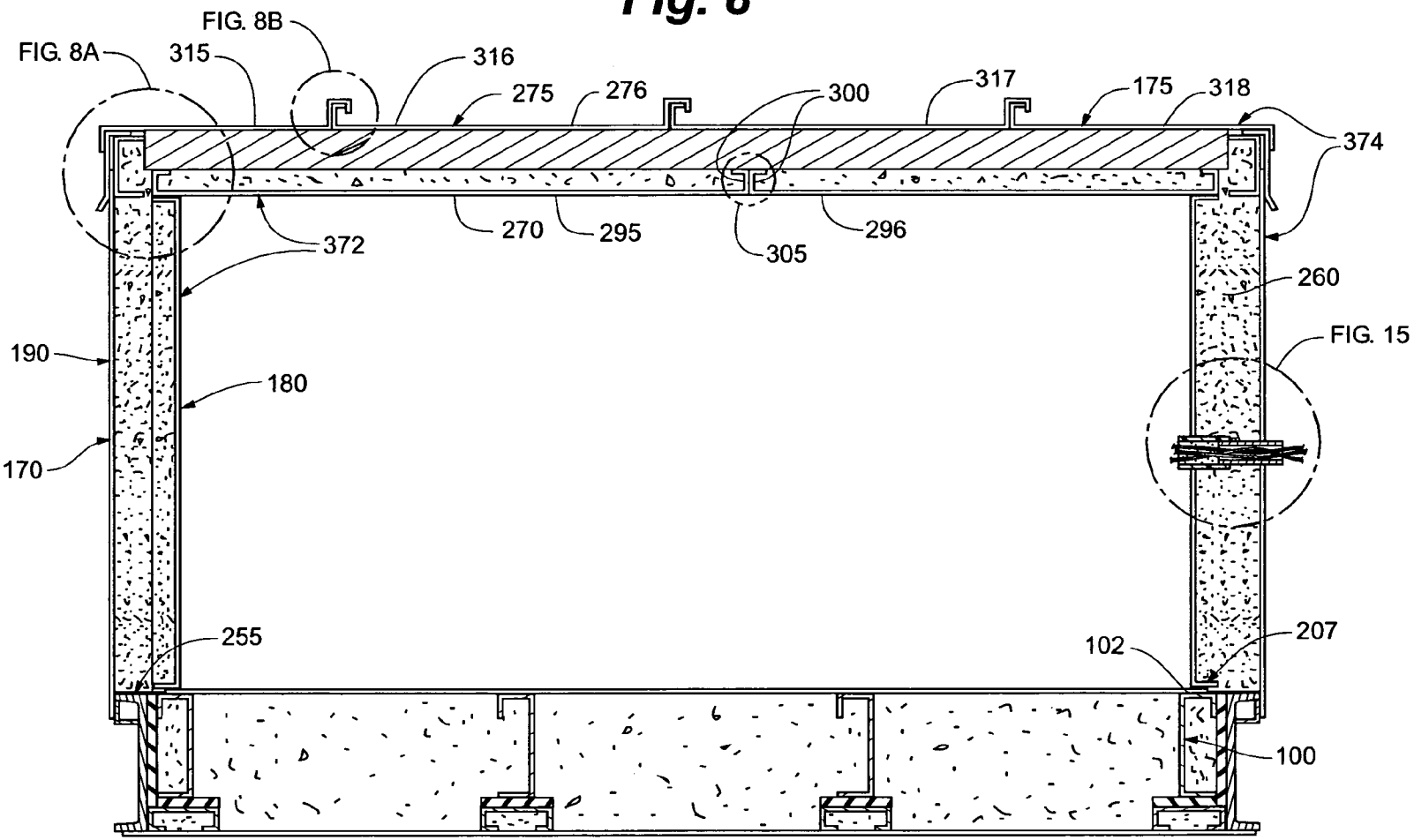
FIG. 8 is a sectional, elevation view of the air chamber.
Figure 8A:
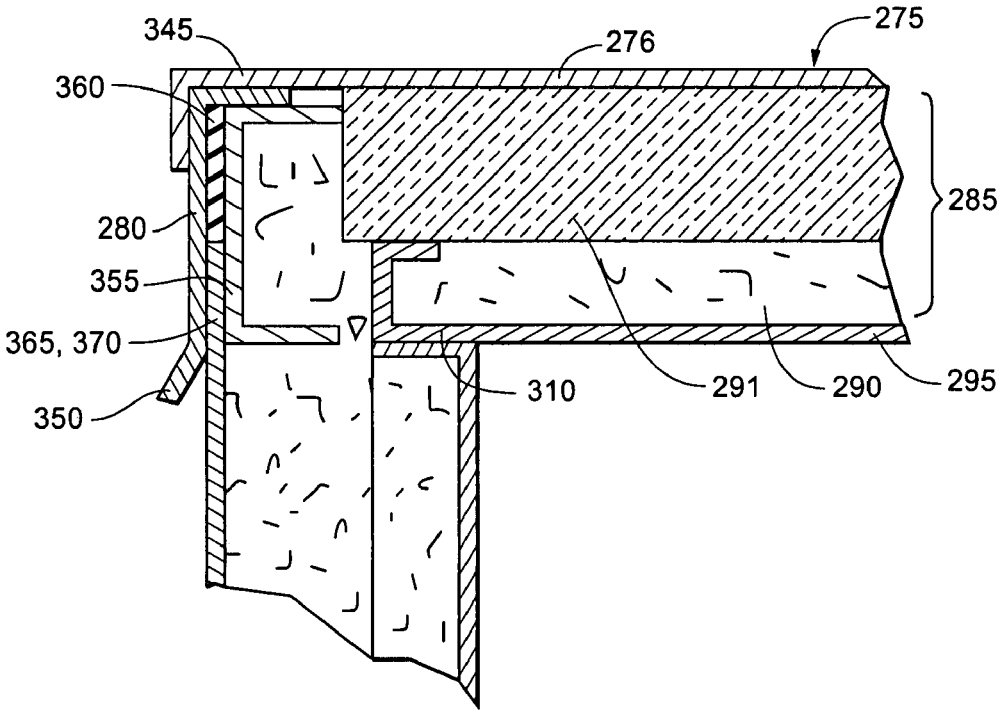
FIG. 8A is an enlarged view taken at 8A of FIG. 8.
Figure 8B:
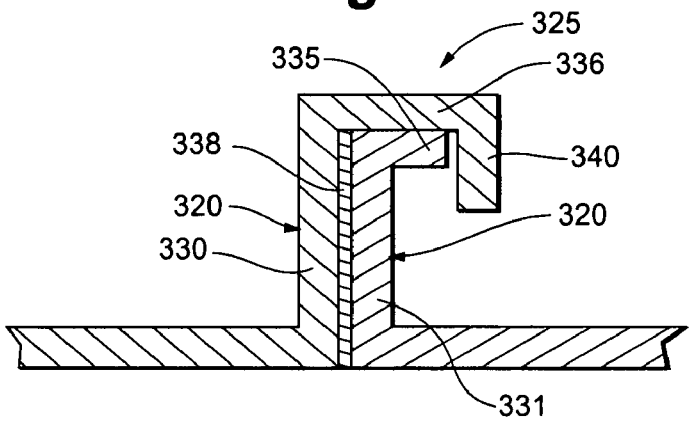
FIG. 8B is an enlarged view taken at 8B of FIG. 8.

Referring to FIG. 8, the interior wall 180 is dimensioned and positioned so that it is entirely supported by the interior frame 100. A bottom flange 207 is formed on the bottom of each interior wall panel 181-188. The bottom flange 207 is fastened or otherwise connected to the top face 102 of the interior frame 100.

Once the interior wall 180 is constructed and mounted onto the interior frame 100, the exterior wall 190 is built around the interior wall 180. The exterior wall 190 is also continuous, and may be constructed from a series of exterior wall panels 191-196 and corner panels 197-200. Each of the exterior wall and corner panels 191-200 have an inward surface 233 that faces toward the gap 202 and an outward surface 234. In the embodiment depicted in FIG. 7, the exterior wall and corner panels 191-200 have at least one flanged edge 235, each having a rib portion 240 that projects perpendicular to the inward surface 233 and a free end portion 245 that depends from the rib portion 240 in a direction parallel to the inward surface 233.

Adjacent flanged edges (e.g. between wall panels 193 and 194) are joined by connecting the abutting rib portions 240 to each other, forming a seam 242 between the adjoined panels. A filler material 244 such as caulk or gasket material may be interstitially located between the abutting rib portions 240. The version of the invention depicted in FIG. 7A illustrates the free end portions 245 of abutting flanged edges 235 extending in the same direction, thereby forming an L-shaped cross-section. The FIG. 7 depiction portrays the joining of a flangeless edge portion 250 on exterior wall panel 193 to exterior corner panel 198. The flangeless edge portion 250 is connected to a portion of the outward surface 234 of the corner panel 198. Flangeless panel edges may be joined to flanged panel edges at any junction on the exterior or interior panels. The seam formed by the union of the flangeless edge portion 250 and the corner panel 198 may be filled with an appropriate sealer (not depicted).

The exterior wall 190 is dimensioned and positioned so that it is entirely supported by the exterior frame 35. In the configuration depicted in FIG. 8, the exterior wall 190 is mounted to the exterior frame 35 through the outer perimeter 62. By this construction, a bottom surface 255 terminating the gap 202 is formed by the top faces 58 and 102 of the exterior frame 35 and interior frame 100, respectively.

The method of joining abutted flanged edges 210 or 235, or for joining the flangeless edges 250 to adjacent panels, as well as the method for mounting the sidewall assembly 170 to the base assembly 15, may be by fusing, welding, crimping, fasteners, or by any other means available to an artisan. In addition to providing a workable means for connecting adjacent panels, the flanged edges 210 and 235 provide strength and buckling resistance to the sidewall assembly 170.

The configuration of the invention illustrated in FIG. 7 limns the flanged edges 210 and 235 of the interior wall panels 181-188 and exterior wall panels 191-200 protruding into the gap 202. While this arrangement may be preferred in many applications, the flanges may also be oriented to protrude away from the gap 202.

Figure 9:
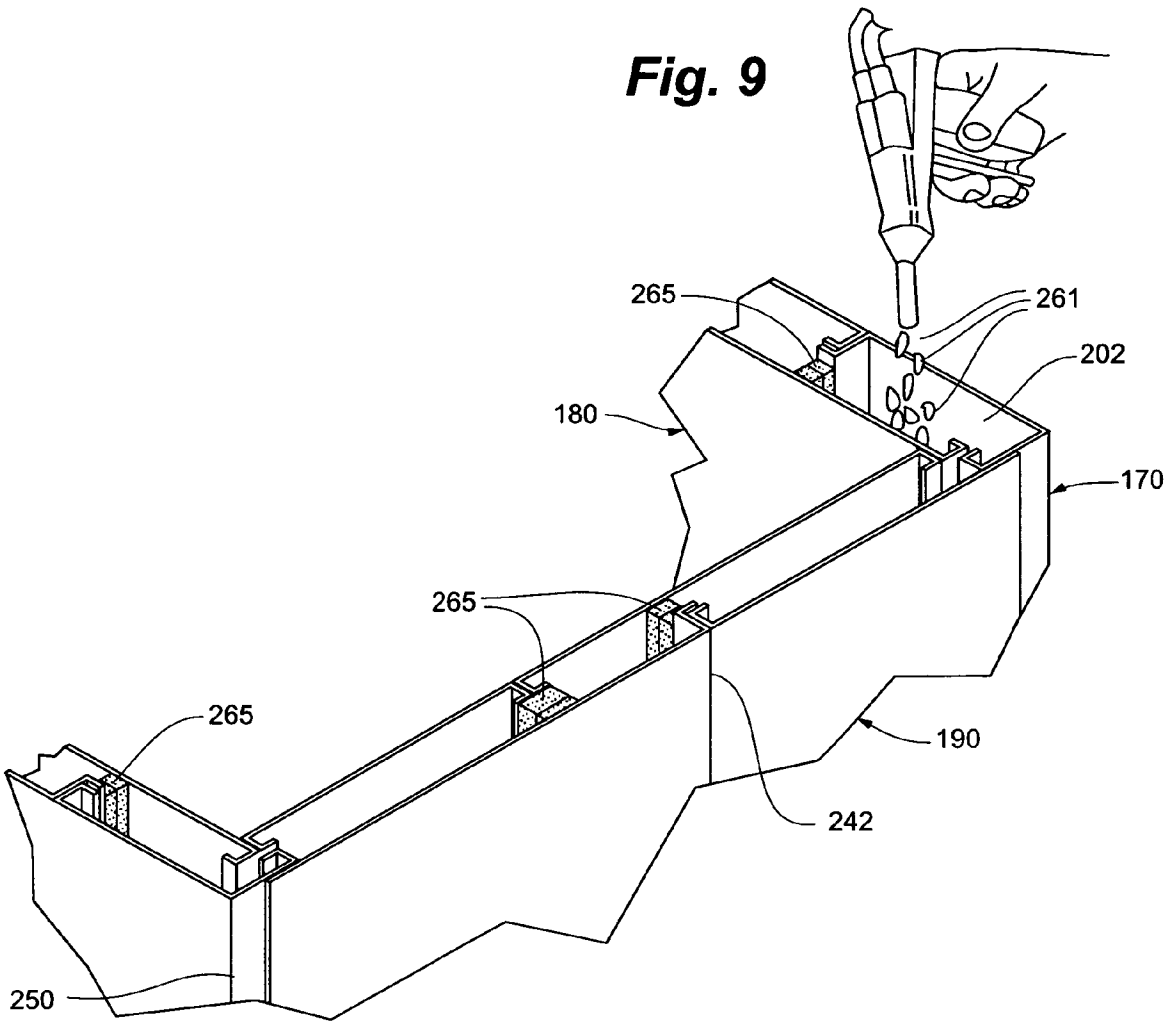
FIG. 9 is a fragmentary, perspective view of a portion of a sidewall assembly, without insulation, but depicting the installation of insulation.
Figure 10:
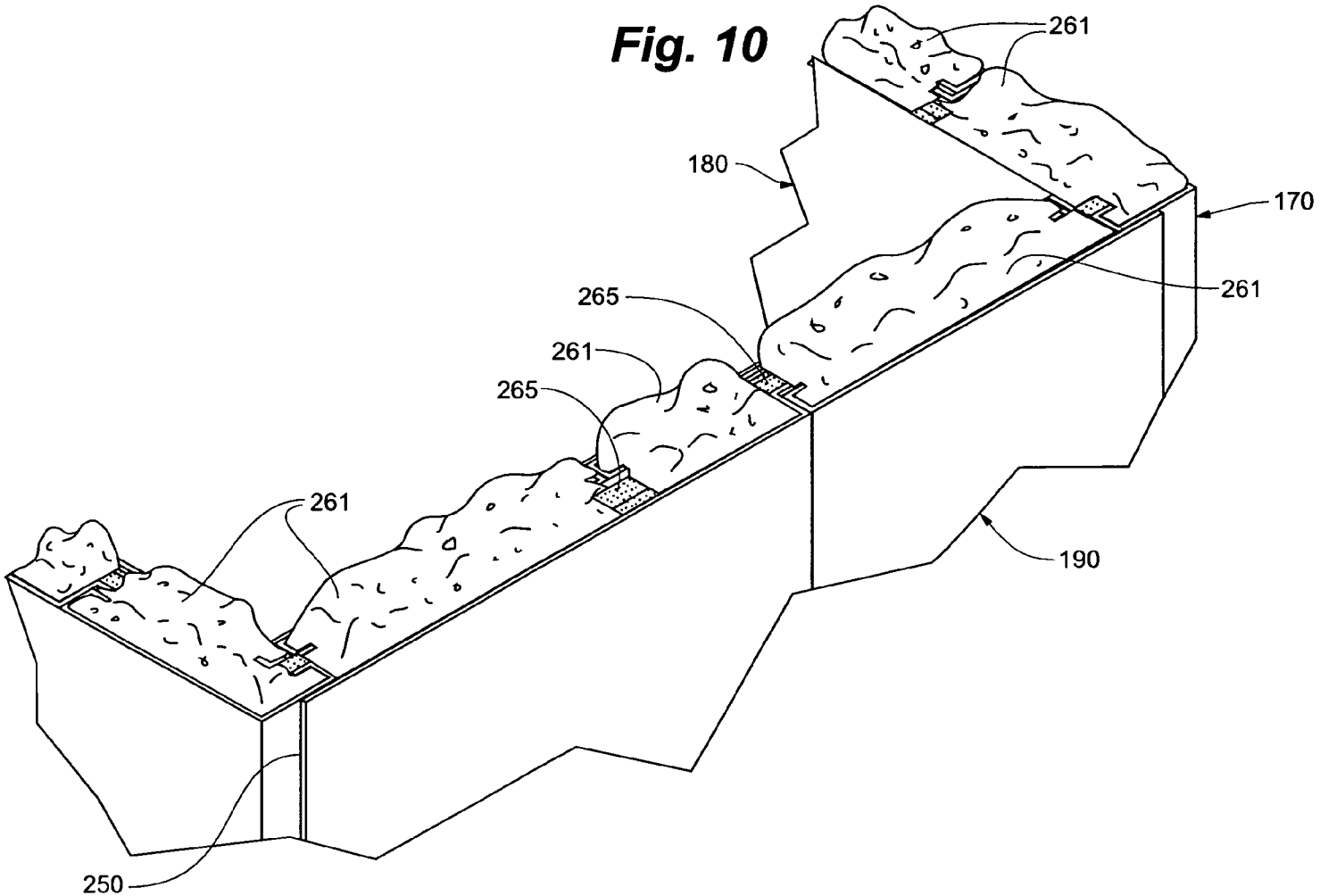
FIG. 10 is similar to FIG. 9, but depicting insulation partially installed in the sidewall.
Figure 11:
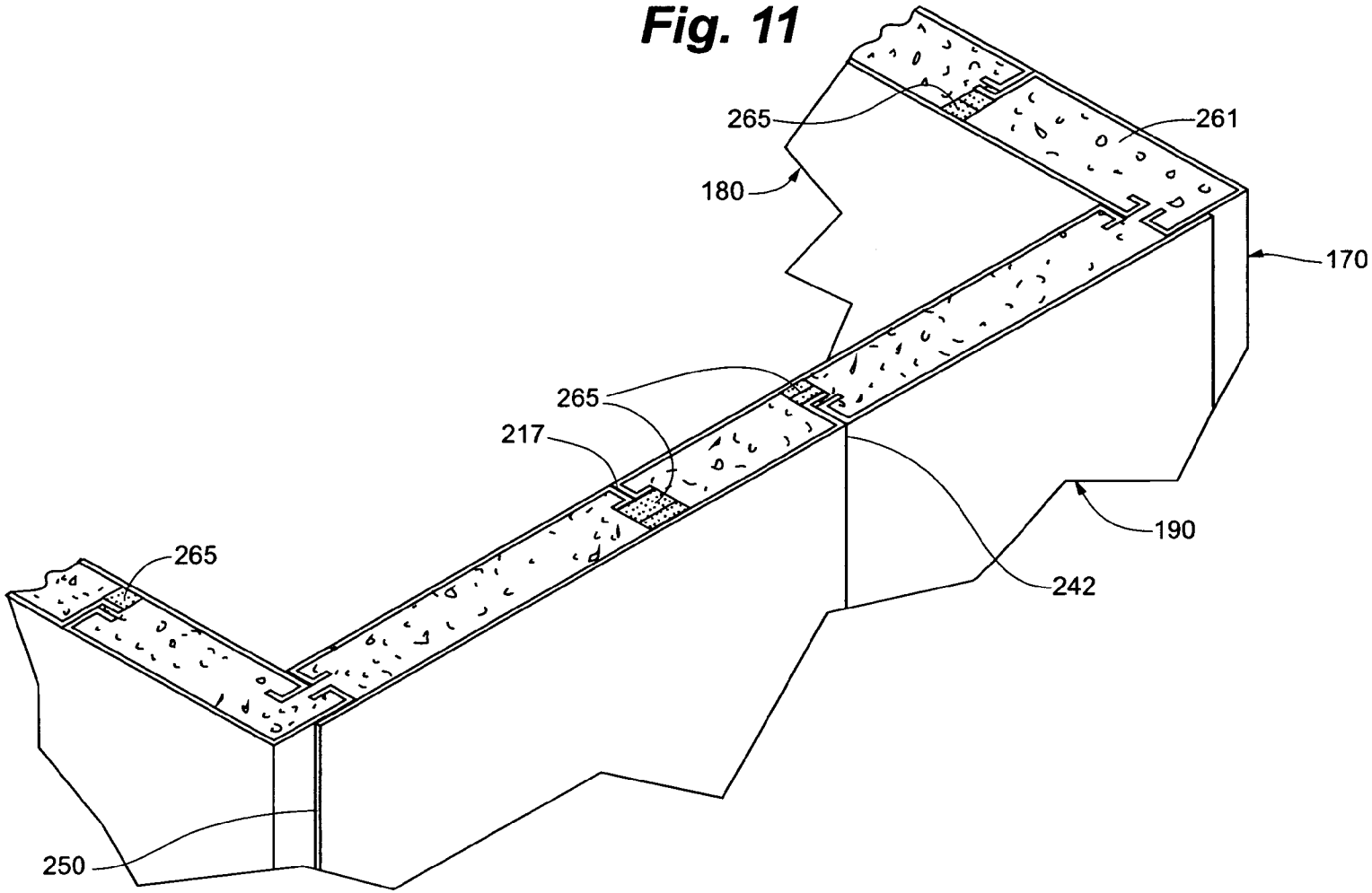
FIG. 11 is similar to FIG. 10, but with insulation installation completed.

Referring to FIGS. 9 through 11, the gap 202 is filled with an insulation material 260. Neoprene spacers 265 may be used to maintain proper spacing between the interior wall 180 and the exterior wall 190. While any appropriate insulation may be used, a preferred insulation material is a multi-component "slow rise" polyurethane foam 261, such as HANDI-FOAM® SR, manufactured by Fomo Products, Inc. of Norton, Ohio. The slow rise polyurethane 261 is gunned into the gap 202, as portrayed in FIG. 9, and onto the bottom surface 255 of the gap 202. The slow rise polyurethane 261 slowly expands to fill the gap 202 and overflow the top edges of the sidewall assembly 170, as depicted in FIG. 10. After the slow rise polyurethane 261 is cured, the excess overflow is shaved flush with the top edges of the sidewall assembly 170.

The embodiment of FIG. 7 also illustrates some flanged edges 210 of the interior wall 180 in a "staggered" arrangement with respect to the flanged edges 235 of the exterior wall 190. That is, the flanged edges 235 of the exterior wall 190 are sometimes located approximately mid-way between the flanged edges 210 of the interior wall 180.

The filler materials 218 and 244 help prevent leakage through the sidewall assembly 170 and the attendant transpiration cooling of the exterior seams 242. The "staggered" relationship between interior flanged edges 210 and exterior flanged edges 235 serves at least two functions. First, if the interior and exterior flanged edges 210 and 235 are aligned directly opposite each other, there is a relatively short conduction path through the thermal insulation material 260 between the respective free ends 220 and 245. By staggering the interior and exterior flanged edges 210 and 235, the thickness of the insulation material 260 between a given free end 220 or 245 and the opposing exterior or interior wall 190 or 180 is increased, resulting a higher operating temperatures for the exterior wall 190, thereby reducing the chance of condensation formation and accumulation.

Second, the staggered arrangement functions to increase the path length between any leaks that may occur between the corresponding interior seams 217 and exterior seams 242. The increased path length through the insulation material 260 reduces leakage through the sidewall assembly 170. Also, it is preferred, but not necessary, that the insulation material 160 be of a closed-cell form to further inhibit leakage through the side wall assembly 170.

The T-shaped and L-shaped cross-sections 222 and 237 also cooperate to enhance leakage resistance through the sidewall assembly 170. Air leaking through a T-shaped cross-section 222 will initially enter the insulation material 260 in the gap 202 at an angle that is perpendicular to the center line 203 of the gap 202. On the other hand, air leaking through an L-shaped cross-section 237 will initially enter the gap 202 in a direction that is parallel to the center line 203. The orthogonal relationship between the entry vectors forces the air to travel a tortuous path, further increasing the leak path resistance. The various means of increasing the leak path resistance combine to reduce the leakage of air through the sidewall assembly 170 and to decrease the attendant transpiration cooling of the exterior wall 190 near the exterior seams 242. This allows the exterior wall to operate at a higher temperature, thereby reducing the chance of forming and accumulating condensation.

A cross-sectional view of the cap assembly 175 is also illustrated in FIG. 8. The cap assembly 175 includes a ceiling 270 and a roof assembly 275 that define a cap interior 285.

The cap interior is filled with thermal insulation material 290. The ceiling 270 may be formed by joining individual ceiling panels 295 and 296, or as one continuous sheet (not depicted). As in the formation of the interior and exterior walls 180 and 190, the ceiling panels 295 and 296 may be formed with flanged edges 300 appropriate for the formation of T-shaped cross-sections 305 or L-shaped cross-sections (not depicted), as previously discussed. The flanged edges may protrude into the cap interior 285 as limned in FIG. 8, or protrude downward from the ceiling 270 (not illustrated).

While the thermal insulation material 290 may be of any appropriate type, a preferred form is rigid insulation board 291. Rigid insulation board 291 is structurally self-supporting (meaning that it can span a significant distance without external support) and lends structural support to the roof assembly 275. Also, the insulation scheme for the cap assembly 175 may involve a combination of different insulation materials, such as a loose fill insulation between flanged edges 300 of the ceiling panels 295 and 296, capped with rigid insulation board 291 that rests on the flanged edges 300.

The ceiling 270 has an edge portion 310 that extends over the interior wall 180. The weight of the ceiling 270 and the portion of the weight of the insulation material 290 that is supported by the ceiling 270 is thereby transferred to the interior base 30 through the interior sidewall 180. In some instances, the self-supporting nature of rigid insulation board 291 allows its weight to be shifted to the roof assembly 275 or directly to the exterior wall 190.

The roof assembly 275 includes a top portion 276, an outer portion 280 and a channel frame 355. The top portion 276 may be formed by joining individual roof panels 315-318, or may be constructed from one continuous sheet (not portrayed). As in the formation of the interior and exterior walls 180 and 190, the roof panels 315-318 may be formed with flanged edges 320. The flanged edges 320 may protrude into the cap interior 285 (not depicted), or protrude upward from the top portion 276 of the roof assembly 275, as detailed in FIG. 8.

While T-shaped and L-shaped cross-sections may be formed between the roof panels 315-318, an alternative is a J-shaped cross-section 325 as detailed in FIG. 8. Like the L-shaped cross section, the J-shaped cross-section includes rib portions 330 and 331 and free end portions 335 and 336 that depend from the rib portions 330 and 331 in the same direction, and a filler material 338 disposed between rib portions 330 and 331. However, the uppermost free end portion 336 of the J-shaped cross section 325 also has a cap edge portion 340 that extends downward from the uppermost free end portion 336. The cap edge portion 340 provides an effective shield against inclement elements such as rain, industrial sprays and the like from entering the seam formed by the junction of the flanged edges 320.

The outer perimeter portion 280 of the roof assembly 275 depends from an edge portion 345 of the top portion 276. The outer perimeter may have a skirt portion 350 at the lower extremity. A channel frame 355 is attached to the top portion 276 inside the outer perimeter portion 280 in the FIG. 8 embodiment of the invention. A spacer 360 is placed between the channel frame 355 and the outer perimeter portion 280, creating a gap 365 therebetween. The spacer 360 may be formed from a gasket or caulk material. The spacer 360 is seated on a protruding upper edge 270 of the exterior wall 190, the upper edge 370 extending into the gap 365.

The skirt portion 350 serves to guide placement of the roof assembly 275 onto the exterior wall 190, and also serves as a drip lip that directs water shedding from the roof assembly 275 away from the unit. The weight of the roof assembly 275, as well as any thermal insulation material 290, 291 supported by these elements, is transferred to the exterior base 25 through the exterior wall 190. When the spacer 360 is formed from a gasket or caulk material, it provides a seal between the exterior wall 190 and the roof assembly 275.

The cap assembly 175 is assembled on the sidewall assembly 170 in the FIG. 8 configuration. The ceiling 270 is placed over the interior wall 180 so that the edge portion 310 of the ceiling 270 extends over the top edge of the interior wall and is attached thereto. The thermal insulation material 290 is then placed over the ceiling 270, followed by the placement of a layer of the rigid insulation board 291 over the thermal insulation material 290. The roof assembly 275 is guided over the protruding upper edge 370 of the exterior wall 190 to encapsulate the thermal insulation 290, 291.

Effectively, the construction of FIG. 8 provides an interior shell 372 mounted on the interior base 15 and an exterior shell 374 mounted on the exterior base 25, with thermal insulation 260 isolating the two structures. The interior shell 372 includes the interior wall 180 and the ceiling 270. The exterior shell 374 includes the exterior wall 190 and the roof assembly 275. There is no direct contact between the interior shell 372 and the exterior shell 374. Accordingly, where metals are used in the fabrication of the interior shell 372 and exterior shell 374, there is no metal-to-metal contact between the two shells.

Figure 12:
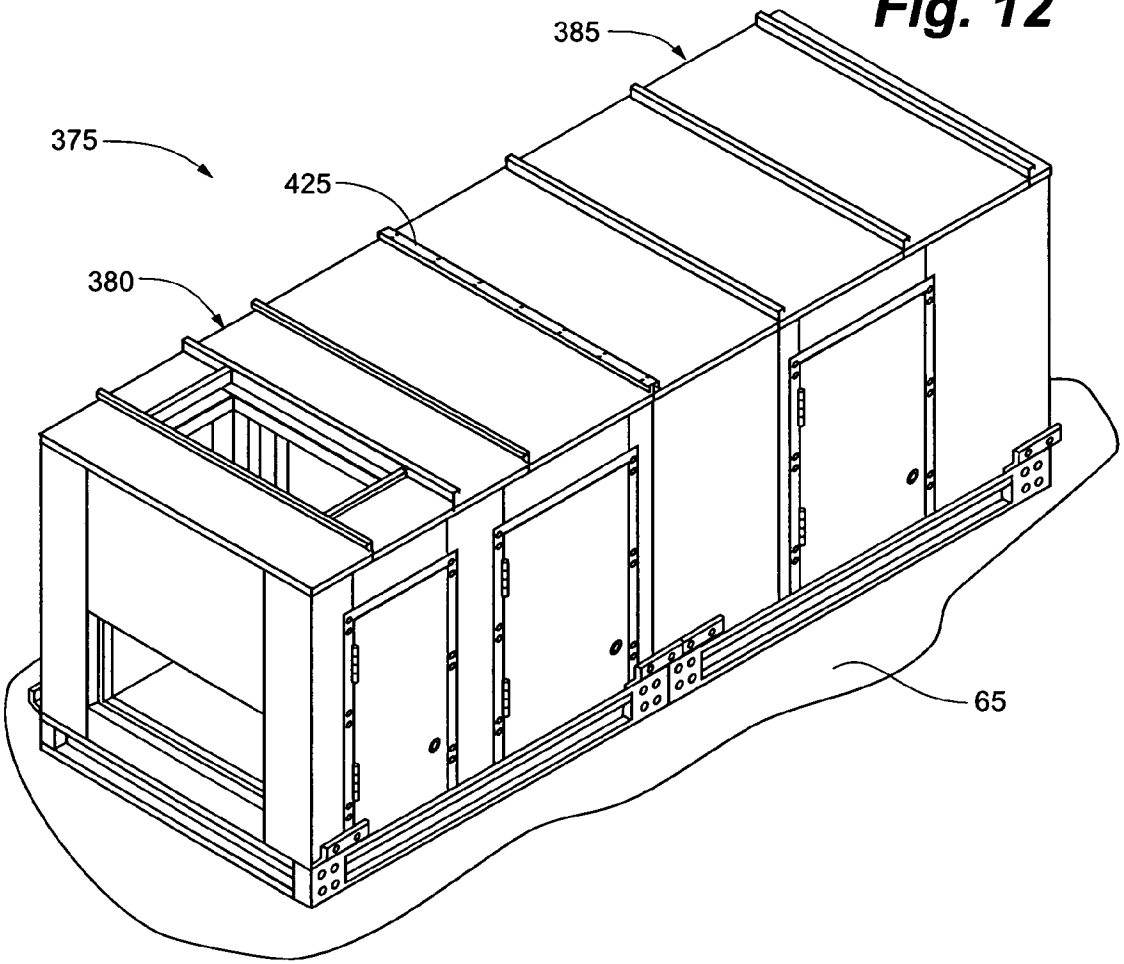
FIG. 12 is a perspective view of an air chamber in accordance with the invention, having an extended chamber.
Figure 13:
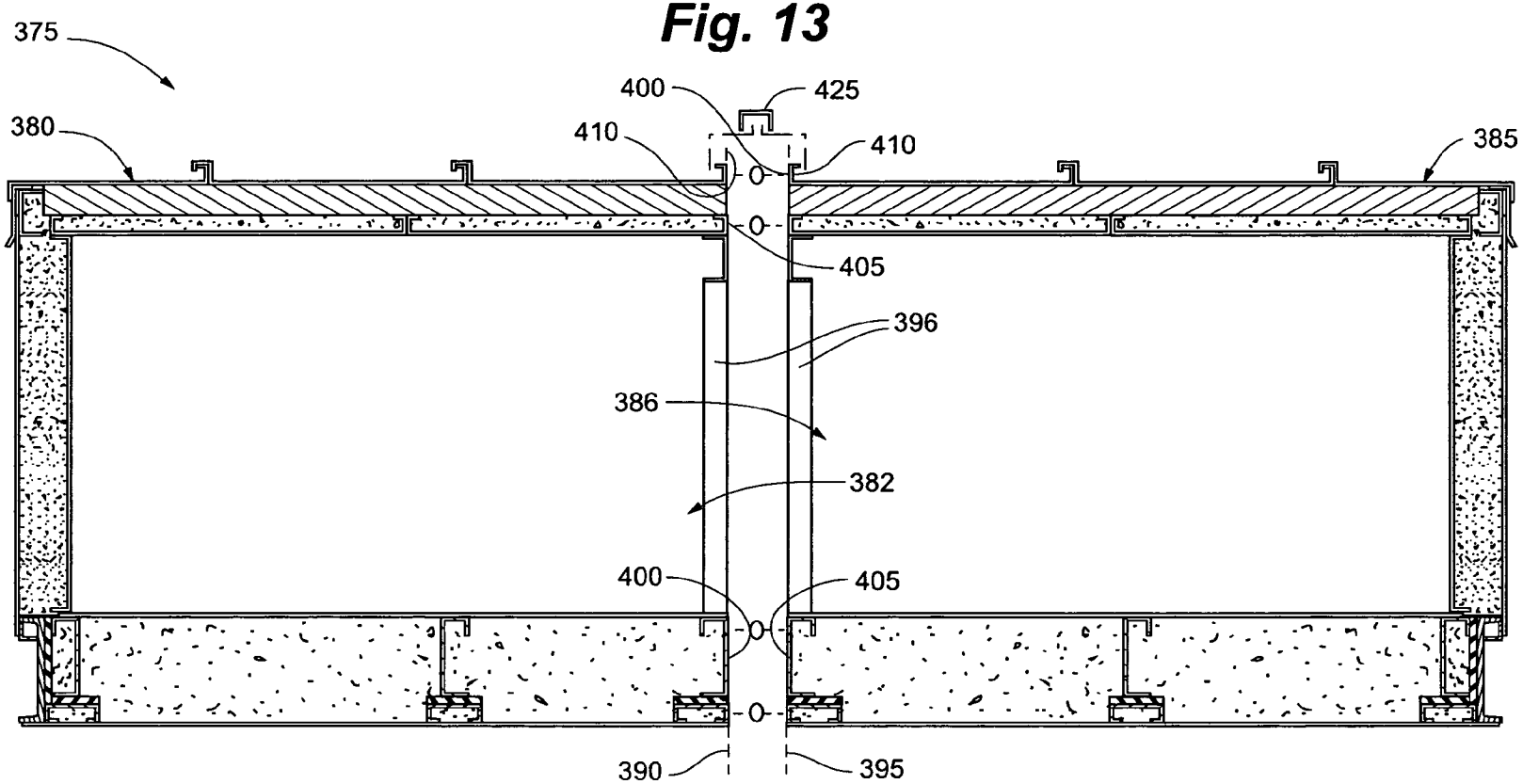
FIG. 13 is a sectional, elevation view of the air chamber of FIG. 12.
Figure 14:
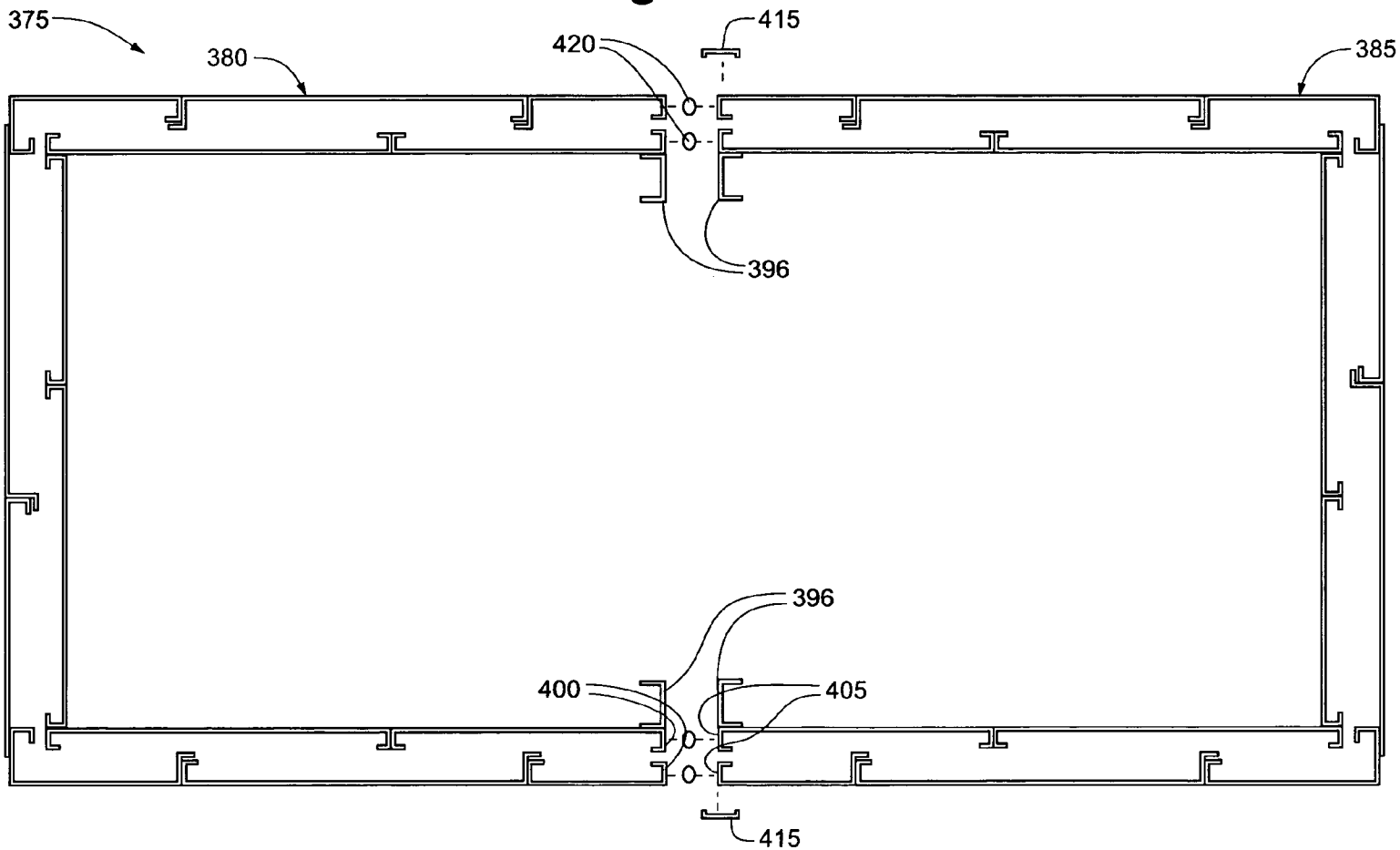
FIG. 14 is a plan view of a sidewall assembly of the air chamber depicted in FIG. 12.

Referring to FIGS. 12 through 14, another version of the invention is presented. Sometimes, it is necessary to divide or split a thermally broken chamber 375 into one or more sections (e.g. to ship the unit or move it into a confined space). Accordingly, the thermally broken chamber 375 is divided into a first section 380 and a second section 385. The first section 380 and the second section 385 each have open ends 382 and 386 that define planes 390 and 395, respectively. A pair of shipping split channels 396 are located at the open end of each section 380 and 385. The base assembly 15, sidewall assembly 170 and cap assembly 175 of each section 380 and 385 are configured to have continuous flanged faces 400 and 405 that are flush with planes 390 and 395, respectively. A sealing material 420 such as a gasket, caulk line or o-ring is placed between the flanged faces 400 and 405 before joining the two sections 380 and 385. An upward extending flange 410 is formed on the top portion 276 of the roof assembly 275 at the interface of the continuous flanged faces 400 and 405. A flange cap 425 is mounted over upward extending flange 410. Sidewall seams (not depicted) that are formed at the interface of the two sections 380 and 385 are covered with strips 415 that may be fastened or bonded to the adjoining exterior walls 190. A sealant such as a gasket or calking (not depicted) may be sandwiched between the strips 415 and the sidewall seams.

In operation, the sealing material 420 seals the interface upon joining the two sections. The shipping split channels 396 provide support for the open ends during shipment and movement, and are used to draw the two sections 380 and 385 together once the chamber 375 is in place. The flange cap 425 and strips 415 prevent incendiary elements such as rain or industrial sprays from seeping into the unit.

Figure 15:
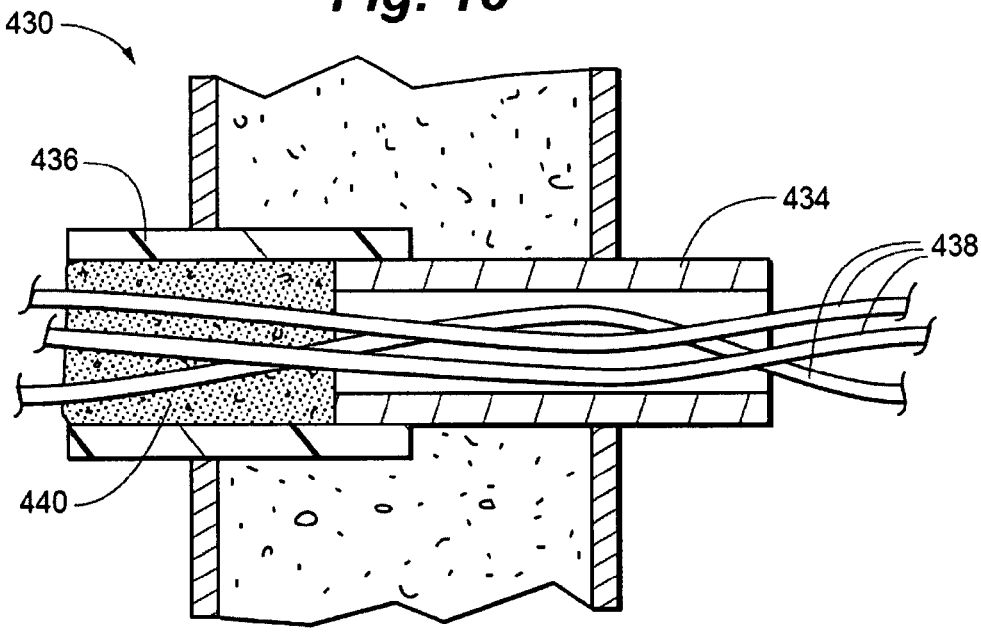
FIG. 15 is a sectional view of an electrical feed through assembly taken at 15 of FIG. 8.

Referring to FIG. 15, an electrical feed through 430 abiding with the concept of the invention is depicted. The electrical feed through 430 includes an electrical conduit 434 joined to a thermal insulative coupling 436 having electrical or signal cabling 438 passing therethrough. The thermal insulative coupling 436 and the electrical conduit 343 may be threadably engaged using thread sizes that are standard in the electrical industry. The thermal insulative coupling 434 is fabricated from a material having a thermal conductivity that is lower than standard electrical conduit, such as PVC pipe or some other polymer or fluoropolymer. The electrical conduit 434 penetrates and is connected to the exterior wall 190 of the sidewall assembly 170, but does not bridge all the way across the gap 202. Rather, the thermal insulative coupling 436 bridges between interior wall 180 and the electrical conduit 434. The region within and/or near the thermal insulative coupling 436 is filled with a thermally insulating sealant 440 such as silicone or epoxy.

Functionally, the electrical feed through 430 thermally isolates the interior wall 180 from the exterior wall 190 by interposition of the thermal insulative coupling 436, which inhibits axial heat conduction through the electrical feed through 430. The thermally insulating sealant 440, in addition to maintaining the pressure integrity of the chamber, prevents cool air from inside the chamber from reaching the electrical conduit 434, thereby cooling it from the inside. The thermally insulating sealant also inhibits radial conduction from the interior wall 180 to the electrical or signal cabling 438, which tend to be high thermal conductors. All of these factors combine to inhibit the cooling of the external wall 190 and the electrical conduit 434, and the attendant formation of condensation thereon. The use of standard threaded couplings on the thermal insulative coupling 436 enables the use of standard electrical conduit during field installation.

Figure 16:
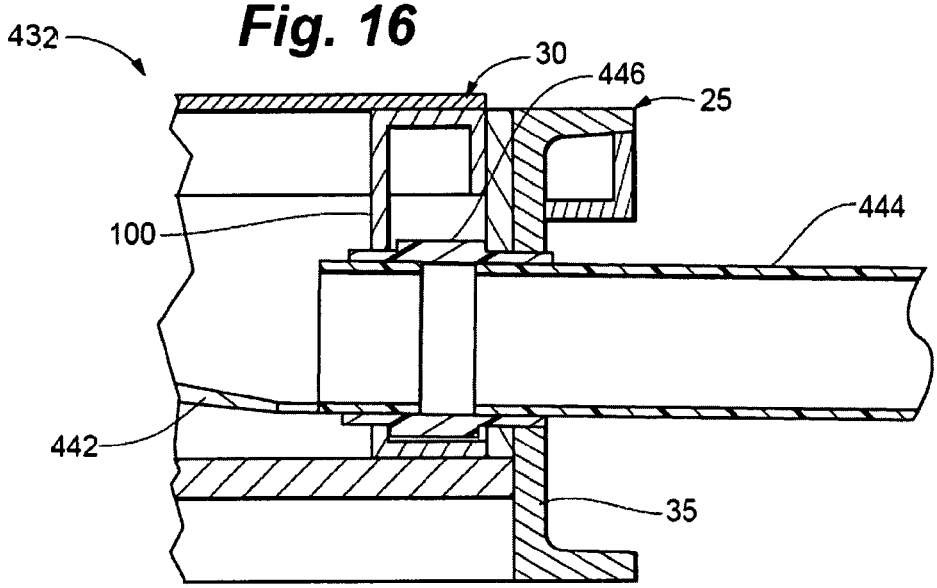
FIG. 16 is a sectional view of plumbing feed through assembly.

Referring to FIG. 16, a plumbing feed through 432 is illustrated. The particular embodiment of the plumbing feed through 432 is tailored to service a drain pan 442, and is conceptually similar to the electrical feed through 430. Specifically, the plumbing feed through 432 includes a drain pipe 444 that passes through the exterior frame 35 and is in fluid communication with the drain pan 442 through a thermal insulative coupling 446, the coupling 446 penetrating the interior frame 100. Alternatively, the drain pipe 444 may be replaced with a plug (not depicted) that blocks the thermal insulative coupling 446, the plug being preferably of a low thermal conductivity.

The effect of the plumbing feed through 432 is the same as for the electrical feed through 430—namely, the interposition of the thermal insulative coupling 446 reduces conduction between interior frame 100 and the exterior frame 35, thus allowing the base assembly 15 to operate at a higher temperature and reduce the chance of condensation formation. Of course, the thermal insulative coupling 446 cannot be filled with a permanent sealant, lest the plumbing feed through not serve its intended purpose of draining the chamber. However, the effect of chamber air cooling the drain pipe 444 may be mitigated by the presence of water that fills the drain pipe 444 and thermal insulative coupling 446. The drain pipe 444 may be sealed off downstream (e.g. with a valve) and drained only periodically, so that over most of the operational life of the chamber there is no air circulating into the drain pipe 444. The water within the drain pipe 444 and thermal insulative coupling 446 will be stagnant, and tend to equilibrate with the local temperature of the surroundings. Hence the mitigation of the cooling effect of an open drain pipe 444. The aforementioned plug in the thermal insulative coupling 446 would produce the same effect.

The preceding discussions assume that the air streams being handled by the various embodiments of the invention are at a temperature less than the temperature of the ambient surroundings. Also, some reference is made to certain structural components being metallic. Such examples are not to be considered limiting, as the invention may have utility in a wide range of air and fluid handling situations, and thermally conductive structural components are not limited to metals. Furthermore, the invention may be embodied in other specific and unmentioned forms without departing from the spirit or essential attributes thereof, and it is therefore asserted that the foregoing embodiments are in all respects illustrative and not restrictive.

What is claimed is:

1. A thermally broken air handling chamber comprising:

a weight bearing exterior base having a pair of spaced apart exterior base side members and a plurality of spaced apart exterior base cross members extending transversely between said exterior base side members, said exterior base presenting a lower, grounding plane of said air handling chamber;

a weight bearing interior base having a pair of spaced apart interior base side members, a plurality of spaced apart interior base cross members having a lower portion and an upper portion, said interior base cross members extending transversely between said interior base side members, and a floor plate in contact with said upper portion of said interior base cross members, said interior base supported by said exterior base with each of said plurality of exterior base cross members being aligned with a respective one of said plurality of interior base cross members in load bearing relationship, said floor plate oriented in spaced apart relationship from said grounding plane;

a structural load bearing thermal insulation material disposed interstitially between said lower portions of respective aligned ones of said interior base cross members and said exterior base cross members, such that said interior base is supported by said exterior base cross members in load bearing, thermally isolated relationship;

a second thermal insulation material disposed between said floor plate and said grounding plane;

an interior shell supported in load bearing relationship by said interior base said interior shell and said interior base cooperating to define an interior chamber;

an exterior shell supported in load bearing relationship by said exterior base said exterior shell being spaced apart from and substantially surrounding said interior shell, said air handling chamber being clear of structural load bearing coupling that bridges said exterior base and said interior base other than through said load bearing, thermally isolated relationship of said interior base and said exterior base cross members.

2. The air handling chamber of claim 1 further comprising structure that defines at least one air passage that passes from one of said exterior shell and said exterior base to said interior chamber.

3. The air handling chamber of claim 1 wherein said interior shell comprises a sidewall portion and a ceiling portion, said ceiling portion being supported by said sidewall portion of said interior shell.

4. The air handling chamber of claim 1 wherein the thermal conductivity of said first and second thermal insulation materials is less than 1 watt per meter per Kelvin.

5. The air handling chamber of claim 1 wherein the thermal conductivity of said second thermal insulation material is less than 0.05 watt per meter per Kelvin.

6. The air handling chamber of claim 1 further comprising a feed through having a thermal insulative coupling that penetrates said interior base or said interior shell, wherein the thermal conductivity of said thermal insulative coupling is less than 1 watt per meter per Kelvin.

7. The air handling chamber of claim 1 wherein said interior shell is comprised of a plurality of interior wall panels, said plurality of interior wall panels including rib portions that are adjoined to define a plurality of interior seams, said exterior shell is comprised of a plurality of exterior wall panels, said plurality of exterior wall panels including rib portions that are adjoined to define a plurality of exterior seams, said second thermal insulation material being disposed between said interior shell and said exterior shell such that air that leaks between adjoined ribs of said interior seams and between adjoined ribs of said exterior seams also passes through said second thermal insulation material.

8. The air handling chamber of claim 7 wherein at least one of said plurality of interior seams are aligned approximately midway between an adjacent pair of said exterior seams in a staggered arrangement.

* * * * *

UNITED STATES PATENT AND TRADEMARK OFFICE

CERTIFICATE OF CORRECTION

PATENT NO. : 7,937,895 B2
APPLICATION NO. : 11/397921
DATED : May 10, 2011
INVENTOR(S) : Janka et al.

It is certified that error appears in the above-identified patent and that said Letters Patent is hereby corrected as shown below:

Column 5, Line 24:
Delete “comers” and insert -- corners --.

Column 6, Line 60:
Delete “bacterial” and insert -- bacteria --.

Column 8, Line 37:
After “resulting” delete “a” and insert -- in --.

Signed and Sealed this
Twentieth Day of December, 2011

David J. Kappos

David J. Kappos
*Director of the United States Patent and Trademark Office*